US005815845A

United States Patent [19]

Ault et al.

[11] Patent Number: 5,815,845

[45] Date of Patent: Oct. 6, 1998

[54] POCKET BILLFOLD WITH THEFT PREVENTING FEATURE

[76] Inventors: Phillip H. Ault, 3765 Church Rd., Ellicott City, Md. 21043; Patricia P. Landrem, 11217 N. Five Points Rd., Knightstown, Ind. 46148

[21] Appl. No.: 908,315

[22] Filed: Aug. 7, 1997

[51] Int. Cl.[6] ..... A41D 27/20; A45C 1/06

[52] U.S. Cl. ..... 2/249; 150/134

[58] Field of Search ..... 2/227, 249, 250; 150/132, 133, 134, 137, 138, 139

[56] References Cited

U.S. PATENT DOCUMENTS

| | | |
|---|---|---|
| D. 125,518 | 2/1941 | Buxton . |
| D. 376,994 | 12/1996 | Norris . |
| 1,420,232 | 6/1922 | Baer . |
| 1,683,584 | 9/1928 | Hogan . |
| 2,473,209 | 6/1949 | Lombardi . |
| 2,602,209 | 7/1952 | Tinnerman . |
| 2,609,855 | 9/1952 | Rothschild . |
| 2,652,090 | 9/1953 | Henderson . |
| 2,697,861 | 12/1954 | Shively . |
| 2,795,023 | 6/1957 | Howell . |
| 2,908,306 | 10/1959 | Chorost . |
| 3,148,424 | 9/1964 | Provenzano . |
| 3,242,959 | 3/1966 | Glass . |
| 3,947,925 | 4/1976 | Hargrave, Jr. . |
| 3,999,701 | 12/1976 | Ward . |
| 4,121,323 | 10/1978 | Letostak . |
| 4,134,437 | 1/1979 | Finn . |
| 4,237,583 | 12/1980 | Sullivan . |
| 4,309,797 | 1/1982 | Schrougham et al. . |
| 4,355,440 | 10/1982 | Johansson et al. . |
| 4,705,086 | 11/1987 | O'Neill . |
| 4,784,199 | 11/1988 | Wise . |
| 4,824,703 | 4/1989 | Bernard . |
| 4,825,922 | 5/1989 | Rolfs . |
| 4,903,745 | 2/1990 | Roman . |
| 4,968,453 | 11/1990 | MacDonald . |
| 5,020,193 | 6/1991 | Kunze . |
| 5,031,281 | 7/1991 | Devylder . |
| 5,103,884 | 4/1992 | Roman . |
| 5,327,619 | 7/1994 | Ortega . |

FOREIGN PATENT DOCUMENTS

| | | |
|---|---|---|
| 571998 | 12/1993 | European Pat. Off. . |
| 6-113915 | 4/1994 | Japan . |

*Primary Examiner*—C. D. Crowder
*Assistant Examiner*—Shirra L. Jenkins
*Attorney, Agent, or Firm*—Rosenberg, Klein & Bilker

[57] ABSTRACT

A pocket billfold removably securable within a front pocket includes a pair of panels forming a container for holding bills, currency, credit cards, and the like. The pocket billfold has a notched corner portion at the top of the container. The pocket has a rivet on its top line adjacent the side seam of the pocket. When the billfold is inserted into the pocket, the notched corner portion of the container engages the underside of the riveted portion of the pocket and the side thereof, preventing the billfold from unintended removal from the pocket. A clip secured to one of the panels of the billfold grips the material of the front of the pocket and provides additional protection of the billfold within the pocket.

19 Claims, 7 Drawing Sheets

POCKET BILLFOLD WITH THEFT PREVENTING FEATURE

FIELD OF INVENTION

The present invention relates to means for preventing the unauthorized or accidental removal of a billfold from a pocket, and more particularly to a billfold for being worn in a front pocket of a garment and having shape and configuration impedimental to unwanted removal of the billfold from the front pocket, and provided with a clip facilitating in securing the billfold in the pocket.

BACKGROUND OF THE INVENTION

Descripton of Prior Art

Men, women, and children often carry their credit cards, identification cards, bills, currency, and other valuable belongings in wallets or pocket billfolds. Usually billfolds are carried in rear pockets of pants or trousers, or are secured to belts of trousers or skirts.

For instance, U.S. Pat. Nos. 4,784,199 and 5,103,884 describe wallet which is provided with a removable clip which permits the wallet to be clipped onto a wearer's waistband or for carrying the wallet in the pocket. These wallets are provided with a clip which is removable for the wallet to be conveniently placed in the wearer's pocket like a clipless wallet. These Patents do not describe any means securing the wallet within the pocket or preventing the wallet from being removed from the pocket accidentally or by a non-authorized person.

A protection device intended for preventing the unauthorized or accidental removal of a billfold from a pocket is described in U.S. Pat. No. 3,947,925. This billfold protection device prevents unwanted unbuttoning of a pocket in which a billfold is contained. The device is made of resilient sheet material and serves its purpose being attached to a pocket on a garment in which the pocket material is buttoned by a button and connected by threads or other means to the garment and passes through a buttonhole in the pocket material. The device includes a vertical extending U-shaped member which is adapted to be positioned in the pocket between the pocket material and the garment with the legs of the U-shaped member straddling the thread connecting the button to the garment. An upwardly extending flange is adapted to be positioned between the button and the pocket material to abut the lower portion of the button to prevent the ready removal of the device from the pocket and the unbuttoning of the pocket. This protection device facilitates in securing the wallet or billfold within the pocket, however, the protection function is not provided by a billfold itself; therefore, this protection device should be carried permanently with the wearer of the billfold additionally to the billfold in order to secure the billfold within the pocket. This is believed to be an inconvenient and somewhat complex method for securing the billfold in the pocket and preventing it from being removed therefrom.

It is therefore desirable to have a billfold possessing the function of being secured within the pocket and being prevented from unauthorized or accidental removal therefrom without having additional protection devices serving this purpose.

Currency holding folders having specifically cutout portions thereof are known in the art. For example, U.S. Pat. No. 3,999,701 is directed to a currency holding folder. The folder has a bottom panel 12, a cover flap 14 connected to the rear edge of the bottom panel by fold 16 and a top flap 18 connected to a front edge of the bottom panel by the fold 20. The folder is adapted to carry various denominations of bills 22 in the pocket 24 from between the cover flap 14 and bottom panel 12 as is more clearly seen in the FIG. 7. A corner cutout section 42 is located at the trailing edge of the folder 10. This cutout section 42 allows for viewing of the currency 22 which is maintained within the currency holding folder. This device does not, however, provide for the closed compartmentalized structure; and the cutout 42 is not intended for the purposes of preventing the'whole currency holding folder from being removed from the pocket of pants or a skirt. As a whole, this structure is not intended to aid in theft prevention.

It would therefore be highly desirable, to provide for a new, convenient in use and manufacture, billfold protection device which would be a feature of the billfold itself and which would reliably prevent the billfold from unauthorized or accidental removal from a pocket.

SUMMARY OF THE INVENTION

It is therefore an object of the present invention to provide a pocket billfold having a shape and configuration facilitating in prevention from being removed by an unauthorized person or accidentally from a pocket where it is worn.

It is another object of the present invention to provide a pocket billfold forming a container for currency, bills, credit cards, and identification cards and having a notched corner portion which being in engagement with a rivet on a top line of the pocket, would lock the billfold in place within the pocket, and would prevent the billfold from being moved out of the pocket and within the pocket.

It is still an object of the present invention, to provide a billfold having a clip for gripping the material of the pocket, thereby providing an additional prevention feature for the billfold.

It is a further object of the present invention to provide a billfold which itself would be capable of preventing itself from being removed out of the pocket and simultaneously which would be attractive to a user by having certain decorative features thereon.

It is still an object of the present invention to provide a billfold which would be designed to be worn in a front pocket of pants or skirts.

It is also an object of the present invention to provide a billfold which is contoured in such a way that to facilitate ingress into the pocket.

It is yet another object of the present invention to facilitate ingress into the pocket by securing a clip member at a predetermined angle.

It is still an object of the present invention to provide a method of preventing a billfold from being accidentally or without authorization to be removed from the pocket.

The present invention will find particular utility as a pocket billfold prevention device, however, the features and teachings of the present invention may find application in any other field where a certain item is to be prevented from being removed out of a compartment or container.

According to the teaching of the present invention, a pocket billfold is removably secured within the front pocket of a garment. The pocket billfold includes a pair of panels which are connected along the sides and bottom, and thereby form a container for holding currency, credit cards, bills, identification cards, and the like. The panels have top edges which contour an opening of the billfold. Of essence that a notched corner portion is provided at one of the upper corners of the billfold. The notched corner portion has first and second edge sections thereof angled to each other. When the pocket billfold is inserted into the pocket, first portion engages a rivet on a pocket top line from below of this rivet thereby preventing the billfold from being removed out of the pocket; and the second edge section of the notched corner portion engages this rivet from the side thereof thereby preventing the billfold from moving towards the side seam of the pocket, thereby preventing the billfold from being moved in both directions. Therefore, the arrangement having a notched corner portion provides for locking the billfold in place, thereby preventing unauthorized or accidental removal from the pocket.

Preferably, the top edges of the billfold are formed with an arcuate contour to coincide with the pocket top line. As an important feature, a clip is attached at the top of one of the panels for gripping the pocket to provide additional protection to the billfold within the pocket. The clip is angled with respect to the folded edge of the billfold to facilitate insertion and guide the billfold into the pocket.

Each of the panels has an internal side and an external side thereof. The clip has two legs jointed to each other (integrally or by some other means) and forming a certain type of connection therebetween (resilient, riveted, or pivoted). One of the legs is secured within a retention pocket on the internal side of one of the panels or is riveted to the panel directly; while another of the legs of the clip engages a front surface of the pocket, thereby securing the billfold to the pocket. An overlaying finger extends from the retention pocket and overlays the second leg of the clip. A decorative plate is attached to this second leg of the clip and may carry any decorative design thereon. The overlaying finger protrudes between the second leg and the decorative plate.

An interior divider may be secured to one of the panels in order to form a separate compartment within the container, for example for carrying credit cards separately from bills.

The panels of the billfold, retention pocket, and interior divider may be made from such material such as leather, leather-like materials, reptile skins, or fabrics with lining materials which are listed above.

It is important that the billfold of the present invention is designed for being worn in a front pocket of a garment as opposed to the back pocket that provides even better protection to the billfold.

Viewing the present invention from another aspect thereof, the present invention is a pocket billfold having a common base which is geometrically divided into a first panel area and a second panel area. Both first and second panel areas are integrally connected along a longitudinal axis of the common base. A top edge of the common base is notched substantially at the center thereof to form a cutout portion having a pair of side subsections and a bottom section therebetween. An interior divider is attached to a first panel area and the common base is folded along its longitudinal axis, so that the bottom and two sides of the common base are sewn to each other and the cutout portion is positioned at the corner of the billfold. This cutout portion engages a rivet on the top line of the pocket and secures the billfold to the place within the pocket. A clip is secured by one of its legs to the first panel area and once the billfold has been inserted into the pocket and is disposed in proper mutual disposition with respect to the rivet, the clip is locked onto the top of the pocket, thereby providing additional protection to the billfold.

Viewing the present invention from still another aspect thereof, the present invention is a method of locking a pocket billfold within a pocket. According to this method, a pocket billfold having a notched corner portion thereof is provided and secured within the pocket having a rivet on the top line thereof in proper orientation of the notched corner with respect to the rivet. The protection is provided by the cutout portion when it engages the rivet from below and from one side thereof, thus preventing the billfold from moving out of the pocket and within the pocket, and additional protection is provided by a clip on the billfold.

These and other novel features and advantages of this invention will be fully understood from the following detailed description and the accompanying drawings.

DESCRIPTION OF THE PREFERRED EMBODIMENTS

Figure 1:
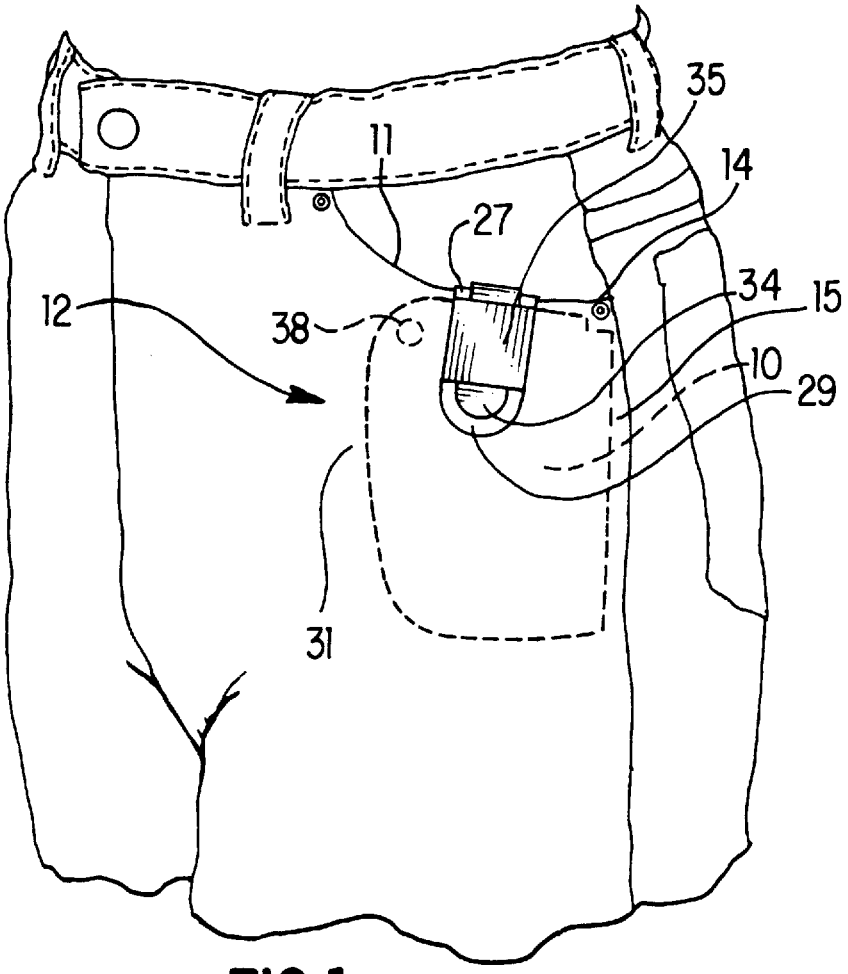
FIG. 1 shows a billfold of the present invention worn in a front pocket of jeans.
Figure 9:
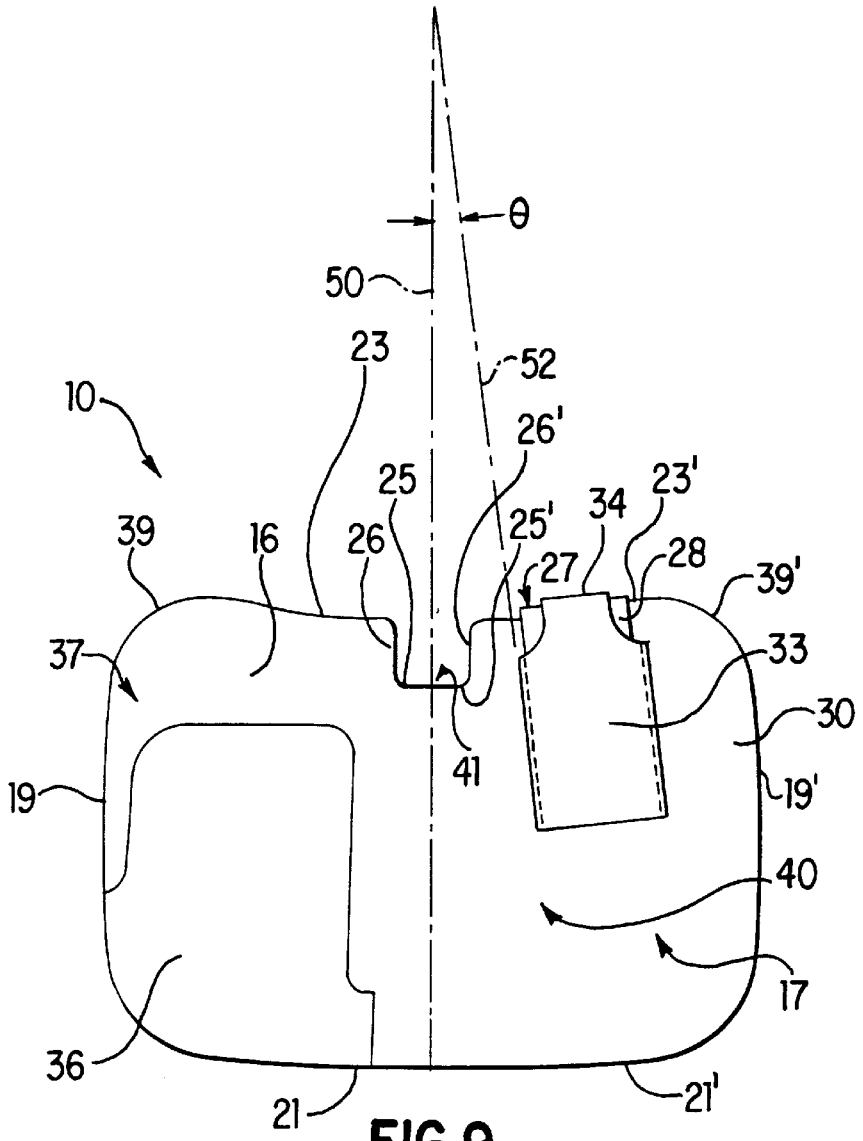
FIG. 9 show a billfold of the present invention prior to assembly thereof and particularly shows the interior divider and oversewn retention pocket for the clip.
Figure 10:
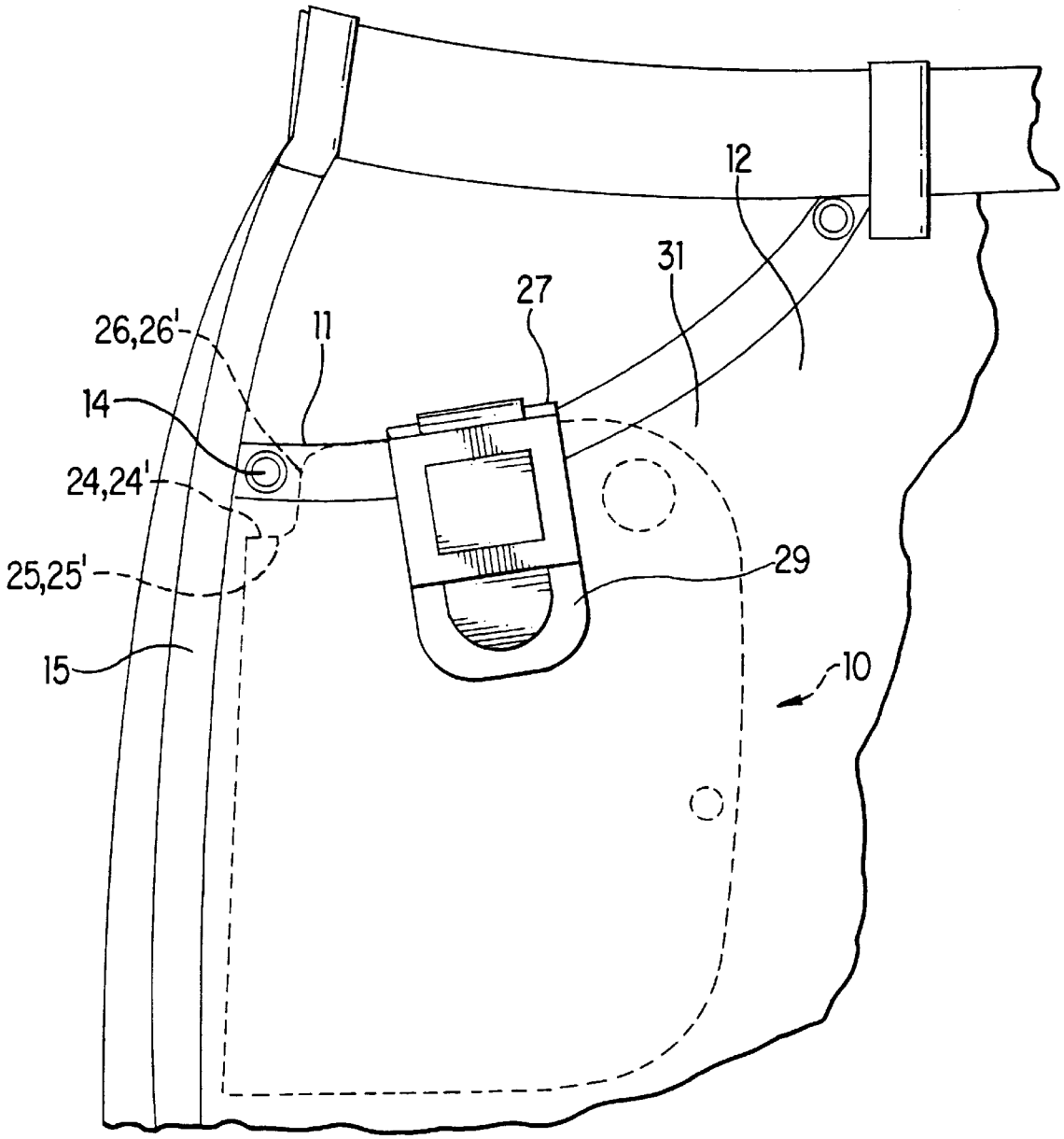

Referring to FIGS. 1–10, a practical, useful, and secure container for men, women, and children for carrying their currency, credit cards, identification, and the like is provided. The billfold 10 is provided for security and comfort through a unique contour which follows the pocket top line 11 and is to be worn in either front pocket of trousers, jeans or skirts. The billfold 10 is secured within the pocket 12 by a pocket clip, which may be decorative, as best shown in FIGS. 1 and 10. The pocket 12 has a pocket top line 11 and a rivet 14 thereon. The rivet 14 is located in close proximity to the side seam 15 of the pocket 12, however, slightly distant therefrom.

Figure 2:
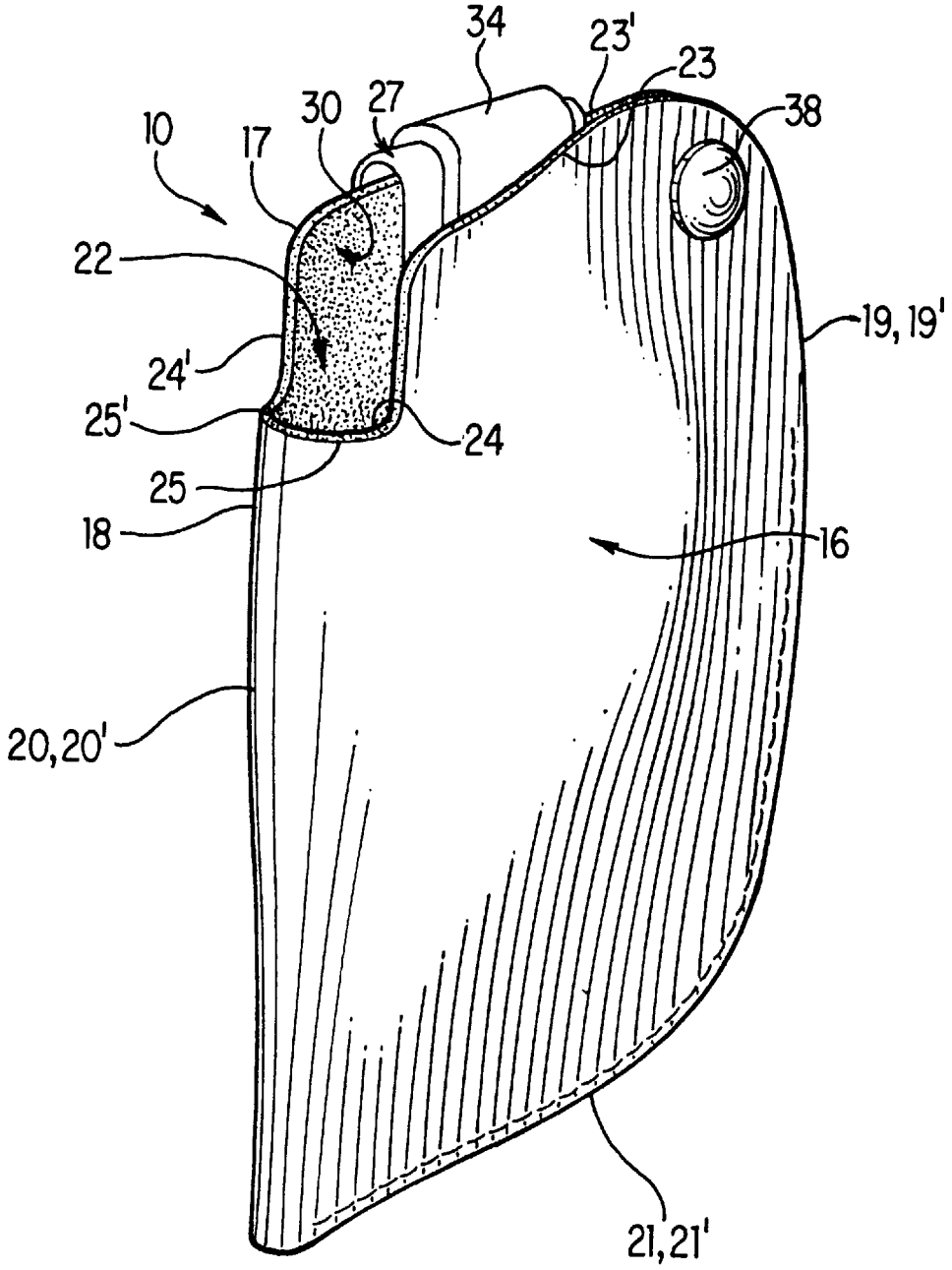
FIG. 2 is a prospective view of the billfold of the present invention.
Figure 4:
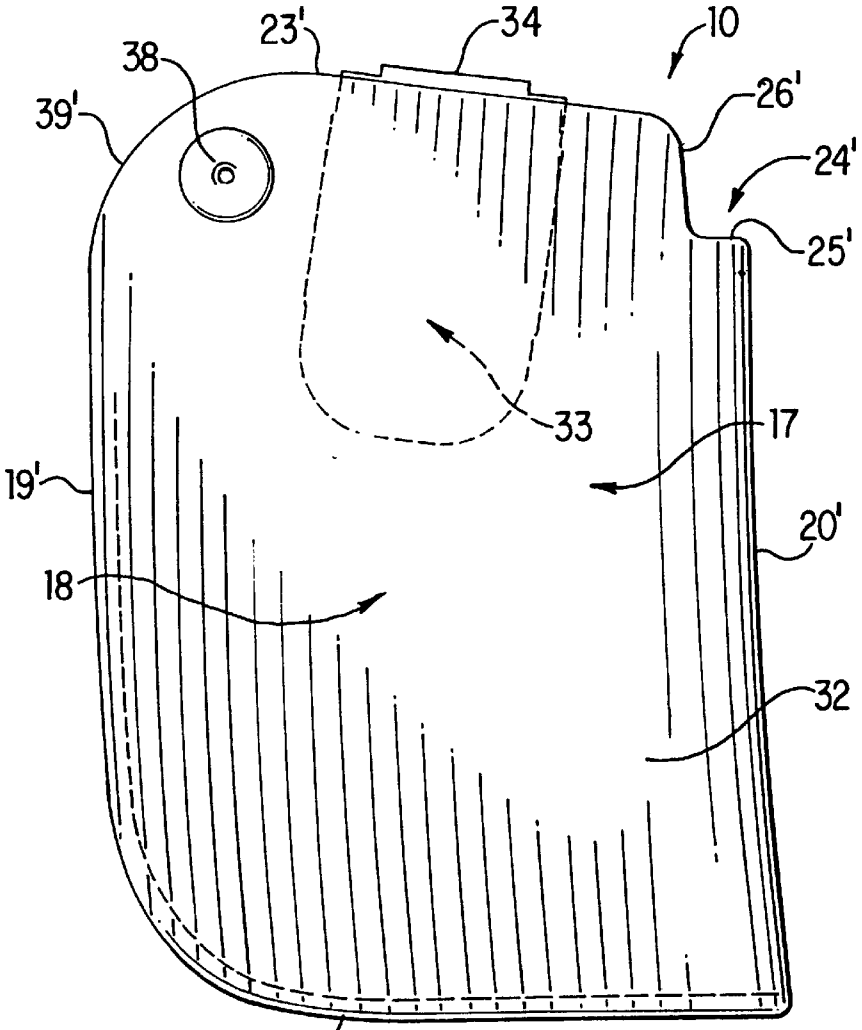
FIG. 4 is a rear view of the billfold of the present invention.
Figure 3:
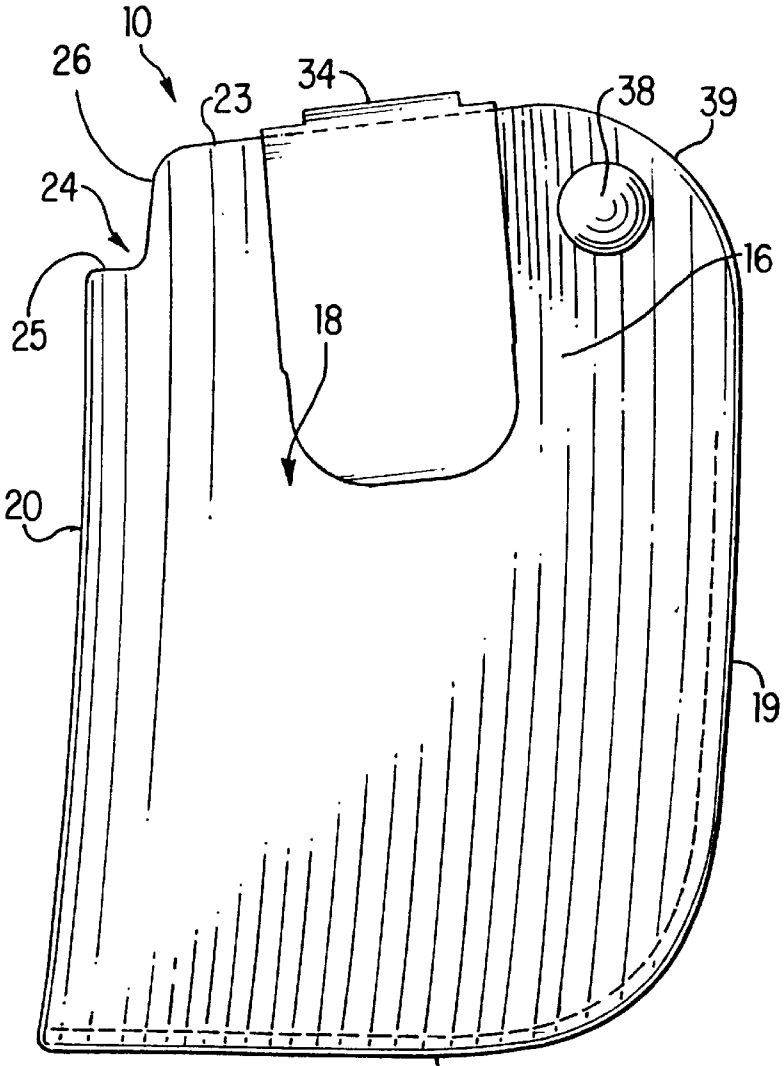
FIG. 3 is a front view of the billfold of the present invention.
Figure 6:
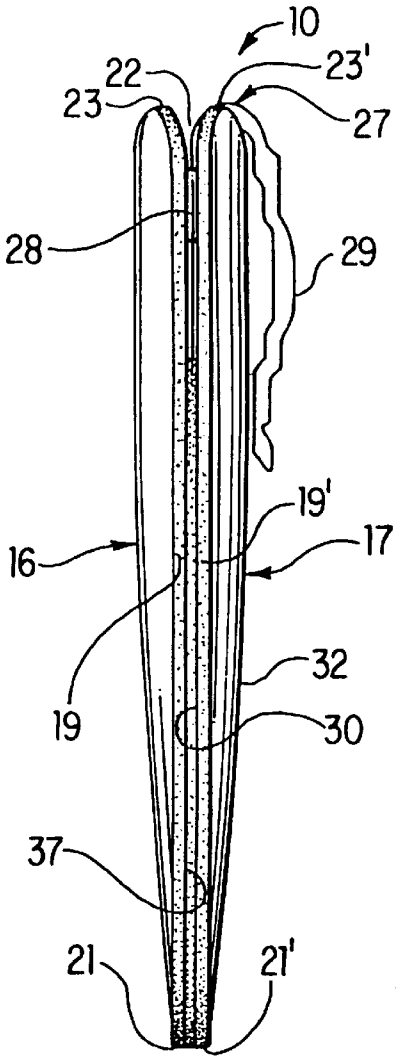
FIG. 6 is another side view of the billfold of the present invention.
Figure 5:
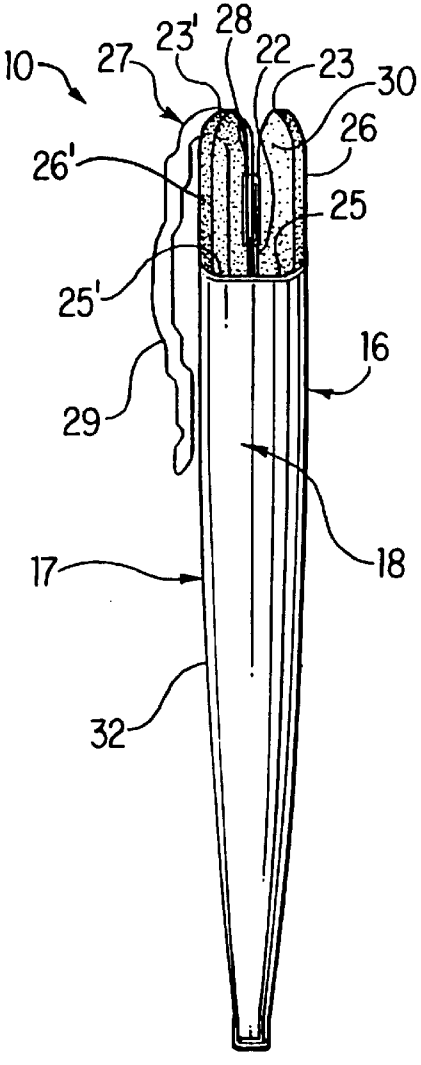
FIG. 5 is a side view of the billfold of the present invention.
Figure 7:
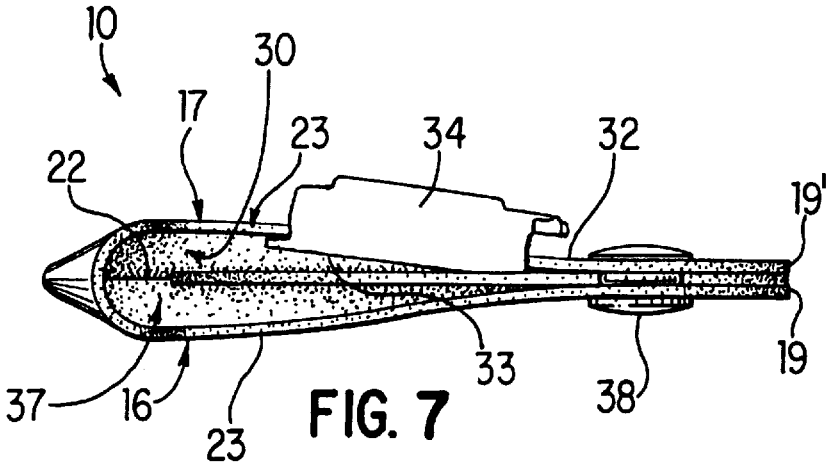
FIG. 7 is a top view of the billfold of the present invention.
Figure 8:
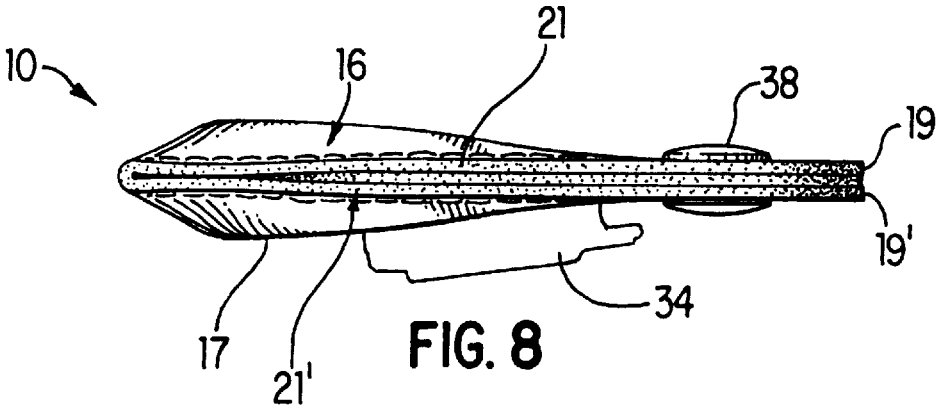
FIG. 8 is a bottom view of the billfold of the present invention.

As best shown in FIGS. 2, 3, and 9, a pair of panels 16 and 17 (which also may be referred to as panel areas), when secured together constitute a container 18 for holding different items such as currency, bills, credit cards, etc. Each panel has two side edges 19, 19' and 20, 20' and a bottom edge 21, 21'. Side edge 19 of the panel 16 and 19' of the panel 17; side edge 20 of the panel 16 and 20' of the panel 17; and bottom edge 21 of the panel 16 and 21' of the panel 17 are connected to each other. As best shown in FIGS. 2, 3, and 4, the side edges 20 and 20' are integrally connected to each other and constitutes a longitudinal axis of the whole structure along which the billfold is folded. The bottom edges 21, 21' and side edges 19, 19' are sewn to each other. It will be understood by those skilled in the art that the side edges 20 and 20' need not be integrally connected, but may be joined by other means, such as riveting, sewing, glueing, etc. The side edges 19 and 19' and bottom edges 21 and 21' can be connected by some other means as well, for instance by gluing them, etc. An upper opening 22 of the billfold 10 is formed on the end of the billfold 10 opposite to the bottom edge 21, 21' thereof. The upper opening 22 is contoured by the top edges 23, 23' of the panels 16 and 17 respectively.

The panels 16 and 17 each have a notched corner portion 24, 24' at the top edges 23 and 23', respectively. Each of the notched corner portions 24 and 24' includes a first edge section 25, 25' and a second edge section 26, 26', angled one with respect to the other. As best shown in FIG. 2, the first edge sections 25, on the panel 16, and 25', on the panel 17, are integrally connected to each other, thereby forming a solid lip at the intersection of first and second panels 16 and 17.

As best shown in FIG. 10 which illustrates on an enlarged scale a portion of the billfold 10 and how the notched corner portions 24, 24' engage the area of the pocket secured by rivet 14, the first edge section 25, 25' engages the rivet 14 from below, while the second edge section 26, 26' engages the rivet 14 from the side thereof. By that arrangement the billfold 10 is prevented from being removed from the pocket 12, the billfold 10 being stopped from being moved towards the side seam 15 of the pocket 12, or upwardly therefrom. Thereby the notched corner portion 24, 24' on the billfold 10 provides a locking mechanism preventing an unintentional removal of the billfold 10 from the pocket 12.

An additional prevention function is provided by a clip 27 which is attached at the top of one of the panels, for example panel 17. As shown in FIGS. 2, 5, 6, 9, and 10, the clip 27 includes two legs 28 and 29, which are joined to each other and form a connection therebetween. The particular type of clip is not important to the inventive concept of the present invention, which clip may be a resilient clip, a buckle-type clip, a riveted clip, etc. Such clips are known to those skilled in the art and need not be described in detail herein. The leg 28 is attached to the internal side 30 of the panel 17, while another of the legs 29 engages a front surface 31 of the pocket 12, thereby resiliently pressing an external side 32 of the panel 17 to a rear surface (not shown) of the pocket 12, thereby providing additional protection to the billfold 10 within the pocket 12.

As best shown in FIGS. 4 and 9, a retention pocket 33 is oversewn on the internal surface 30 of the panel 17. It will be understood by those skilled in the art that other means of securing the retention pocket 33 on the panel 17 like gluing, etc. are to be considered to be within the scope of the present invention. The retention pocket 33 retains the leg 28 of the clip 27 and has an extending portion of the material thereof that forms an overlaying finger 34 extending from the retention pocket 33 and overlaying the leg 29 of the clip 27.

Figure 9A:
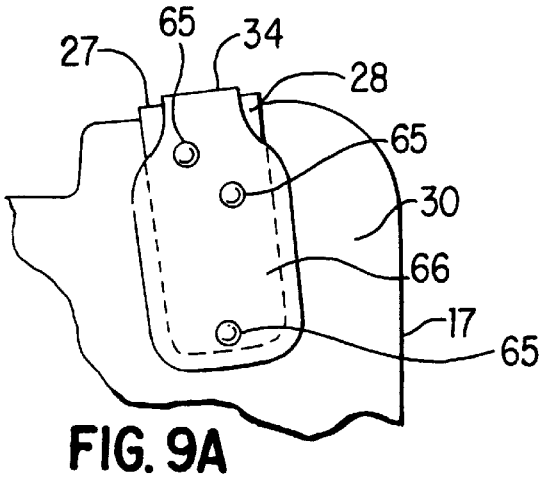
FIG. 9A is an enlarged view of a portion of the interior of the present invention showing an alternate mounting of the clip; and, FIG. 10 shows somewhat on an enlarged scale thereof, the billfold of the present invention in a front pocket, and particularly shows a mutual disposition of the notched corner and the rivet on the top line of the pocket.

As best shown in FIG. 1, the clip 27 is embellished by a decorative plate 35 attached to the leg 29 of the clip 27 or integrally formed therein, so that the overlaying finger 34 protrudes between the leg 29 and the decorative plate 35. This decorative plate 35 may carry any desired design thereon. The finger 34 serves to aid in retaining clip 27 and adds to the decorative effect. As shown in FIG. 9A, clip 27 may alternately be retained by one or more rivets 65. If desired, a piece of material, like that from which retention pocket 33 would be formed, may also be secured to panel 17 by rivets 65. The member 66 may also be formed to have an overlaying finger 34 that is threaded under the plate 35, for providing a decorative effect.

As best shown in FIG. 9, an interior divider 36 is secured to the internal surface 37 of the panel 16, forming a separate compartment within the container 18 for carrying for example business cards separate from bills, for example.

As best shown in FIGS. 2, 3, 4, 7, and 8 a connecting snap 38 is provided on a respective corner 39, 39' of the panels 16 and 17 to releasably snap the top of the container 18 together, thereby keeping its contents in place. Design of the connecting snap 38 is known to those skilled in the art and will not be described in detail herein and although only one snap is shown, it is contemplated that a plurality of snaps may be used. In lieu of snaps, a zipper, Velcro, or other closure mechanisms known to those skilled in the art may be used at the top of the container to keep the contents therein in place.

The panels 16 and 17, as well as retention pocket 33 and overlaying finger 34 may be made of leather, leather-like material, reptile skins, or fabrics with lining materials as listed above. The main requirement to the material for manufacture of billfold 10 is that it must have a weight sufficient to provide stability during use and also to provide a rugged and casual interior finish. The interior divider 36 may be made of any single or combination of above named materials. The outer edges of the exterior material and any lining may be secured with bias or edging materials of various materials in such a manner as to provide a neat finished appearance to the container 18. Other decorative elements may be placed upon the exterior materials and various clip styles may be utilized, as deemed appropriate. With respect to appearance of the container, the billfold may have, for instance, a western flair, or some other decorative peculiarities. The size and shape of the billfold 10 and the whole design thereof is chosen to be comfortable for being worn within the pocket 12.

As part of a nice and neat appearance, as well as for comfort, the billfold 10 has a unique contour which follows the pocket top line 11 and is designed to conveniently fit into one of the front pockets 12 as opposed to placing a ordinary billfold in a back pocket, thereby providing additional prevention from theft. By securing clip 27 to panel 16, container 18 is then adapted for insert and retention in a pocket 12 on the other (left vs. right)side of the user. As best shown in FIGS. 3 and 4, the upper edge 23, 23' of each panel 16, 17 has an arcuate contour. The arcuate contour functions to maintain the upper edges 23 and 23' below the pocket top line 11, thereby securing the container 18 portion of the billfold 10 from view. By that arrangement, the security of billfold 10 is enhanced.

As best in shown in FIG. 9, the billfold 10 includes a common base (or plane) 40 having first and second side edges 19 and 19', a bottom edge consisting of bottom edges 21 and 21', and a top edge which consists of top edges 23 and 23'. A first panel area 16 and second panel area 17 are integrally connected along a longitudinal axis 50 of the common base 40. The top edge of the common base 40 is notched substantially at the center thereof, forming a cutout portion 41 which subsequently forms cutout portions 24 and 24' and has a pair of side edge sections 26, 26' and a bottom section containing both edge sections 25 and 25'. When the common base 40 is folded along the longitudinal axis thereof, with the side edges 19 and 19' and bottom edges 21 and 21' secured to each other, the container 18 is formed with cutout portions 24, 24' as previously discussed. The clip 27 is secured to the common base 40 at an angle θ with respect to the longitudinal axis 50, as indicated by the line 52. The angle θ us within the approximating range of 7 to 15 degrees, and preferably approximates an angle of 10 degrees. The angle of clip 27 facilitates the insertion of billfold 10 into pocket 12, allowing the billfold to be guided into the pocket with the notch formed by cutout portions 24 and 24' clear of the rivet 14. The billfold 10 can then be rotated to position the cutout portion 24, 24' beneath the location of rivet 14.

A user wishing to wear the billfold 10 of the present invention to provide better protection of his or her belongings, places his or her bills and cards and other similar items into the billfold 10. The compartments within billfold 10 provide for separating the items, and the user secures the connecting snap 38 to thereby maintain the contents of the billfold in place. The billfold 10 is then inserted into the pocket 12 with the panel 17 facing towards the outer material portion of the pocket 12. The billfold 10 is inserted with the clip 27 oriented vertically and once the billfold is inserted, it may be rotated towards the side seam 15 of the pocket until the edge sections 25, 25', 26, and 26' of the cutout portions 24 and 24' encompass the rivet 14, as discussed above and shown in FIG. 10. By virtue of the arcuate contour of the top edges 23, 23' of the container 18, those top edges will coincide with the top line 11 of the pocket 12 so that the container 18 will not extend above the top line 11, so as to be hidden from view. The leg 29 of clip 27 will grip the front surface 31 of the pocket material, thereby providing additional protection to the billfold 10 within the pocket 12.

As has been discussed above, the billfold 10 of the present invention provides a container for currency, credit cards, identification, etc. in a manner not before utilized, in that it is thoroughly designed to be worn in a front pocket of pants or a skirt. The design's contour facilitates intentional pocket ingress and egress. The security aspects stem from:

a. the notched corner that provides a locking mechanism to the billfold;

b. the pocket clip which is an essential part of the total design, the clip being at a predetermined angle adapted to allow the wearer to guide the container into the pocket and properly locate the billfold adjacent the pocket side seam, and serves to securely grip the material of the pocket, deterring theft and adding protection during rigorous activity;

c. wearing of the container in a front pocket as opposed to placing an ordinary billfold in a back pocket, in itself deters theft; and, d. one or more snaps at the top of the container keeps its contents in place.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. In combination with a front pocket of a garment having a pocket top line and a rivet thereon, a pocket billfold removably securable within the pocket, comprising:

a pair of panels connected along respective sides and bottom edges thereof, thereby forming a container having an upper opening contoured by top edges of said pair of panels;

each of said pair of panels having a notched corner portion at said top edges thereof, said notched corner portion being defined by first and second edge sections angled, one with respect to the other; and, said first and second edge sections of said notched corner portion being positioned in the pocket to encompass respective sides of the rivet, thereby locking the billfold in place and thereby preventing the billfold from being unintentionally displaced from the pocket.

2. The billfold of claim 1, wherein said first edge section of the notched corner portion engages the rivet from an underside thereof, and said second edge section of the notched corner portion engages the rivet from a side thereof.

3. The billfold of claim 1, wherein said top edges of said pair of the panels are formed with an arcuate contour to coincide with the pocket top line.

4. The billfold of claim 1, further comprising a clip attached to one of said pair of the panels adjacent said top edge thereof for gripping a front material portion of the pocket to secure the billfold within the pocket.

5. The billfold of claim 4, wherein said one of said pair of the panels has an internal side and an external side thereof, said clip including two legs joined to each other and forming a connection therebetween, one of said legs being attached to said internal side of said panel, and said other leg engaging the front material portion of the pocket.

6. The billfold of claim 5, further including a retention pocket formed on the internal side of said panel, said retention pocket retaining said one leg of said clip, said retention pocket having an overlaying finger extending therefrom and overlaying said other leg of said clip.

7. The billfold of claim 6, further including a decorative plate attached to said other leg of said clip, said overlaying finger being threaded between said other leg and said decorative plate.

8. The billfold of claim 1, further including an interior divider secured to at least one of said pair of the panels and forming a separate compartment within said container.

9. The billfold of claim 1, wherein a pair of respective side edges of said panels are connected integrally to each other, and wherein another pair of respective side and bottom edges are sewn to each other.

10. The billfold of claim 1, further including means for releasably connecting said pair of said panels together at said top edges thereof.

11. The billfold of claim 4, wherein said clip is attached to said one panel at a predetermined angle adapted to facilitate insert of said billfold into the pocket.

12. The billfold of claim 1, wherein said pair of panels are formed from a material selected from the group consisting of: leather, a leather-like material, reptile skins, and fabrics with lining materials.

13. The billfold of claim 4, wherein said clip is attached to said one panel by at least one fastener.

14. A pocket billfold which is removably securable within a front pocket of a garment, said pocket billfold comprising:

a common base having (1) first and second side edges, (2) a bottom edge, and (3) a top edge, said common base including a first panel area and a second panel area integrally connected along a longitudinal axis of said common base, said common base being notched at said top edge substantially at a center portion thereof, thereby forming a cutout portion having a pair of side sections and a bottom section extending therebetween; and, an interior divider being attached to said first panel area of the common base, said common base being folded along said longitudinal axis thereof, said first and second side edges being secured to each other and said bottom edge being closed to form a container having an open upper end contoured by said top edge and having said cutout portions at a respective corner thereof, said bottom section of said cutout portion engagable with an underside of a rivet of a pocket having a pocket top line, said pair of side sections of said cutout portion engagable with said rivet from a side thereof opposite to a pocket side seam to lock said pocket billfold in place within a front pocket.

15. The pocket billfold of claim 14, further including a clip having a first leg and second leg connected to each other, said first leg being secured to said second panel area, said second leg engaging a front surface of the front pocket.

16. The pocket billfold of claim 15, further including a retention pocket affixed to an internal surface of said second panel area of said common base and receiving said first leg of said clip therein.

17. The pocket billfold of claim 15, wherein said clip is secured to said second panel at a predetermined angle adapted to facilitate insertion of said pocket billfold into the front pocket.

18. A method of locking a pocket billfold within a pocket, comprising the steps of:

providing a pocket billfold having two panels secured together at two sides and a bottom portion thereof, and forming an opening contoured by an upper edge of said pocket billfold, said pocket billfold having two spaced top corners;

cutting off a respective corner portion of said pocket billfold at one of said top corners;

providing a pocket with a rivet on a pocket top line thereof in proximity to a side seam of said pocket;

inserting the pocket billfold into said pocket; and, guiding the billfold in the pocket until said notched corner portion of the billfold engages said rivet from below and a side thereof, thereby preventing unintended displacement of the pocket billfold from the pocket.

19. The method of claim 18, further including the steps of:

providing a clip at the top of one of said panels; and, gripping the pocket with said clip.

* * * * *